US007330154B2

(12) United States Patent
Kanazawa

(10) Patent No.: US 7,330,154 B2
(45) Date of Patent: Feb. 12, 2008

(54) ANTENNA DEVICE AND WIRELESS COMMUNICATION APPARATUS

(75) Inventor: Masaru Kanazawa, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 9 days.

(21) Appl. No.: 11/050,780

(22) Filed: Feb. 7, 2005

(65) Prior Publication Data

US 2006/0092081 A1 May 4, 2006

(30) Foreign Application Priority Data

Nov. 1, 2004 (JP) ..... 2004-318408

(51) Int. Cl.
*H01Q 1/24* (2006.01)

(52) U.S. Cl. ..... 343/702

(58) Field of Classification Search ..... 343/702, 343/850, 852, 872, 876, 878, 700 MS
See application file for complete search history.

(56) References Cited

U.S. PATENT DOCUMENTS 6,239,755 B1 * 5/2001 Klemens et al. ..... 343/702
6,295,462 B1 * 9/2001 Kudoh ..... 343/702
6,327,485 B1 * 12/2001 Waldron ..... 455/575.3
6,452,558 B1 * 9/2002 Saitou et al. ..... 343/725
6,822,611 B1 * 11/2004 Kontogeorgakis et al. .. 343/702
6,944,433 B2 * 9/2005 Ogino ..... 343/702
7,009,567 B2 * 3/2006 Iwai et al. ..... 343/702
2003/0117324 A1 6/2003 Iwai et al.
2004/0008151 A1 * 1/2004 Kurihara ..... 343/860
2005/0035921 A1 * 2/2005 Huang et al. ..... 343/860

FOREIGN PATENT DOCUMENTS

JP 2002-368850 12/2002
JP 2003-204281 7/2003

* cited by examiner

*Primary Examiner*—Shih-Chao Chen
*Assistant Examiner*—Minh Dieu A
(74) *Attorney, Agent, or Firm*—Arent Fox LLP

(57) ABSTRACT

The present invention relates to an antenna device built into a casing, the antenna device configured to prevent the deterioration of antenna characteristics by switching the antenna operation. The antenna device built into a casing, the antenna device comprises first and second antenna elements disposed in the casing; and a switch unit that is disposed between the first antenna element and the second antenna element and opens and closes. An antenna comprising the first antenna element or the second antenna element is configured as a result of the switch unit being switched to an open state, and an antenna comprising the first antenna element and the second antenna element is configured as a result of the switch unit being switched to a closed state.

13 Claims, 14 Drawing Sheets

FIG.14

| ANTENNA DEVICE | CASING | | UNIT |
|---|---|---|---|
| | OPEN | CLOSED | |
| INVERTED F | −1.0 | 0.0 | dB |
| MONOPOLE | 0.0 | −2.4 | |

ANTENNA DEVICE AND WIRELESS COMMUNICATION APPARATUS

BACKGROUND OF THE INVENTION

1. Field of the Invention

The present invention relates to an antenna device used in various types of wireless communication apparatuses, such as mobile telephones provided with a folding structure. The present invention also relates to an antenna device whose antenna operation is switchable by opening and closing a casing and to a wireless communication apparatus.

2. Description of the Related Art

Various types of antennas, such as whip antennas, are used in mobile telephones. Antennas that protrude from the casing, such as whip antennas, are functionally excellent, but they are inconvenient in that they protrude from the casing, and this interferes with storage and retrieval. For this reason, antennas that are built into the casing have come to be used.

In relation to such antennas built into the casing of mobile telephones, there is a mobile telephone where plural antennas are built into a foldable casing, with stable antenna characteristics and communication quality being excellently maintained without relation to the opening and closing of the casing (e.g., see Japanese Patent Application Laid-Open Publication (JP-A) No. 2002-368850, paragraph no. 50 and FIG. 12). There is also a mobile telephone configured to switch plural antennas (e.g., see JP-A No. 2002-368850, paragraph no. 53 and FIG. 15). There is also a mobile telephone where two antennas are built into a foldable casing, with one antenna being usable in a state where the casing is folded and the other antenna being usable in a state where the casing is not folded (e.g., see JP-A No. 2003-204281).

In wireless communication apparatuses such as mobile telephones, the casing is becoming increasingly compact and designed so as to be foldable, and in this type of casing, the disposal space for the built-in antenna is narrow. When an antenna is disposed in a narrow space, the antenna element comes into close proximity to the grounding conductor (GND), and in wireless communication apparatuses provided with a folding structure, there is the potential for the distance from the grounding conductor resulting from the opening and closing of the device to cause the antenna characteristics to deteriorate. JP-A Nos. 2002-368850 and 2003-204281 neither disclose nor suggest anything in regard to this problem, and the configurations disclosed in JP-A Nos. 2002-368850 and 2003-204281 cannot solve this problem.

SUMMARY OF THE INVENTION

The present invention relates to an antenna device built into a casing, and it is a first object thereof to prevent the deterioration of antenna characteristics by switching the antenna operation.

The present invention also relates to an antenna device built into a casing provided with a folding structure, and it is a second object thereof to prevent the deterioration of antenna characteristics resulting from proximity to the grounding conductor by switching the antenna operation by opening and closing the casing.

In order to achieve the above objects, an aspect of the present invention provides an antenna device built into a casing, the antenna device comprising first and second antenna elements disposed in the casing; and a switch unit that is disposed between the first antenna element and the second antenna element and opens and closes, wherein an antenna comprising the first antenna element or the second antenna element is configured as a result of the switch unit being switched to an open state, and an antenna comprising the first antenna element and the second antenna element is configured as a result of the switch unit being switched to a closed state. According to this configuration, the second antenna element can be added to or cut off from the first antenna element, and the antenna operation can be switched by organizing an antenna comprising only the first antenna element or an antenna comprising the first and second antenna elements.

In the antenna device, the casing may be provided with an opening/closing mechanism, and the switch unit maybe switched to the open state or the closed state in response to the opening and closing of the opening/closing mechanism. Namely, the opening/closing mechanism can be configured by a hinge for example disposed between the casings, but an opening/closing portion other than a hinge may also be used.

In the antenna device, a feeder may be disposed in the first antenna element, and a transmitter or a receiver may be disposed between the feeder and a grounding conductor. The first antenna element may be configured by a conductor plate.

In order to achieve the above objects, another aspect of the present invention provides an antenna device built into a casing that is opened and closed via a hinge, the antenna device comprising first and second antenna elements disposed in the casing; an open/close detector that detects the opening and closing of the casing; and a switch unit that is disposed between the first antenna element and the second antenna element and is opened and closed by the detection of the opening and closing of the open/close detector, wherein an antenna comprising the first antenna element or the second antenna element is configured as a result of the switch unit being switched to an open state, and an antenna comprising the first antenna element and the second antenna element is configured as a result of the switch unit being switched to a closed state. According to this configuration, the opening and closing of the casings opened and closed by the hinge are detected by the open/close detector, and the switch unit is opened and closed by the detection output. As a result, an antenna comprising the first antenna element or the second antenna element is configured as a result of the switch unit being switched to the open state, or an antenna comprising the first antenna element and the second antenna element is configured as a result of the switch unit being switched to the closed state, whereby the antenna operation is switched.

In order to achieve the above objects, a further aspect of the present invention provides an antenna device built into a casing, the antenna device comprising an antenna element disposed in the casing; a grounding conductor disposed in the casing; a short circuit part that causes the grounding conductor and the antenna element to short; and a switch unit that is disposed in the short circuit part and is opened and closed, wherein an antenna comprising the antenna element is configured as a result of the switch unit being switched to an open state, and an antenna comprising the antenna element and the short circuit part is configured as a result of the switch unit being switched to a closed state. According to this configuration, a monopole antenna is configured by only the antenna element, and an inverted F antenna is configured as a result of the short circuit part being added to the antenna element. By adding or not adding the short circuit part to the single antenna element, antennas with different characteristics are organized. Whereas the nearby grounding conductor affects the antenna element and the antenna characteristics deteriorate in a monopole antenna, an inverted F antenna is configured using the nearby grounding conductor, so that an antenna with no characteristic deterioration can be organized in correspondence to the opening and closing of the casings.

In the antenna device, an opening/closing mechanism maybe disposed in the casing, and the switch unit may be switched to the open state or the closed state in response to the opening and closing of the opening/closing mechanism.

In order to achieve the above objects, still another aspect of the present invention provides an antenna device built into a casing that is opened and closed via a hinge, the antenna device comprising an antenna element disposed in the casing; a grounding conductor disposed in the casing; a short circuit part that causes the grounding conductor and the antenna element to short; an open/close detector that detects the opening and closing of the casing; and a switch unit that is disposed in the short circuit part and is opened and closed on the basis of the detection of the opening and closing of the open/close detector, wherein an antenna comprising the antenna element is configured as a result of the switch unit being switched to an open state, and an antenna comprising the antenna element and the short circuit part is configured as a result of the switch unit being switched to a closed state. Namely, in this antenna device, the detection output of the open/close detector is used to switch the switch unit, and the switch unit can be configured by an element such as a diode or electronic switch.

In the antenna device, a feeder may be disposed in the antenna element, and a transmitter or receiver maybe disposed between the feeder and the grounding conductor. The antenna element may be configured by a conductor plate. The antenna element may be formed by a conductor plate, and the short circuit part may be configured by a conductor piece that protrudes from a side portion of the conductor plate. The antenna element may configure a monopole antenna, and the antenna element and the short circuit part may configure an inverted F antenna.

In order to achieve the above objects, yet another aspect of the present invention provides a wireless communication apparatus including an antenna device built into a casing, the wireless communication apparatus comprising first and second antenna elements disposed in the casing; and a switch unit that is disposed between the first antenna element and the second antenna element and opens and closes, wherein an antenna comprising the first antenna element or the second antenna element is configured as a result of the switch unit being switched to an open state, and an antenna comprising the first antenna element and the second antenna element is configured as a result of the switch unit being switched to a closed state. Namely, this wireless communication apparatus is configured as a mobile telephone, for example, and the aforementioned antenna device is built into wireless communication apparatus.

In the wireless communication apparatus as well, the casing may be provided with an opening/closing mechanism, and the switch unit may be switched to the open state or the closed state in response to the opening and closing of the opening/closing mechanism. A feeder may be disposed in the first antenna element, and a transmitter or receiver is disposed between the feeder and a grounding conductor. The first antenna element may be configured by a conductor plate.

In order to achieve the above objects, still yet another aspect of the present invention provides a wireless communication apparatus including an antenna device built into a casing that is opened and closed via a hinge, the wireless communication apparatus comprising first and second antenna elements disposed in the casing; an open/close detector that detects the opening and closing of the casing; and a switch unit that is disposed between the first antenna element and the second antenna element and is opened and closed by the detection of the opening and closing of the open/close detector, wherein an antenna comprising the first antenna element or the second antenna element is configured as a result of the switch unit being switched to an open state, and an antenna comprising the first antenna element and the second antenna element is configured as a result of the switch unit being switched to a closed state. According to this configuration, antennas are organized by one or a combination of both of the built-in first and second antenna elements as a result of the opening and closing of the casings. Thus, the deterioration of antenna characteristics and adverse affects on communication quality resulting from such deterioration can be avoided, and stable communication characteristics can be maintained.

In order to achieve the above objects, yet still another aspect of the present invention provides a wireless communication apparatus including an antenna device built into a casing, the wireless communication apparatus comprising an antenna element disposed in the casing; a grounding conductor disposed in the casing; a short circuit part that causes the grounding conductor and the antenna element to short; and a switch unit that is disposed in the short circuit part and is opened and closed, wherein an antenna comprising the antenna element is configured as a result of the switch unit being switched to an open state, and an antenna comprising the antenna element and the short circuit part is configured as a result of the switch unit being switched to a closed state. According to this configuration, antennas are organized by only the antenna element or the connection between the antenna element and the short circuit part as a result of the switching of the switch unit. Thus, the deterioration of antenna characteristics and adverse affects on communication quality resulting from such deterioration can be avoided, and stable communication characteristics can be maintained.

In the wireless communication apparatus as well, an opening/closing mechanism may be disposed in the casing, and the switch unit may be switched to the open state or the closed state in response to the opening and closing of the opening/closing mechanism.

In order to achieve the above objects, a still further aspect of the present invention provides a wireless communication apparatus including an antenna device built into a casing that is opened and closed via a hinge, the wireless communication apparatus comprising an antenna element disposed in the casing; a grounding conductor disposed in the casing; a short circuit part that causes the grounding conductor and the antenna element to short; an open/close detector that detects the opening and closing of the casing; and a switch unit that is disposed in the short circuit part and is opened and closed on the basis of the detection of the opening and closing of the open/close detector, wherein an antenna comprising the antenna element is configured as a result of the switch unit being switched to an open state, and an antenna comprising the antenna element and the short circuit part is configured as a result of the switch unit being switched to a closed state. According to this configuration, antennas are organized by only the antenna element or the connection between the antenna element and the short circuit part as a result of the opening and closing of the casings resulting from the hinge. Thus, the deterioration of antenna characteristics and adverse affects on communication quality resulting from such deterioration can be avoided, and stable communication characteristics can be maintained.

In this wireless communication apparatus as well, a feeder may be disposed in the antenna element, and a transmitter or receiver may be disposed between the feeder and the grounding conductor. The antenna element may be configured by a conductor plate. The antenna element may be formed by a conductor plate, and the short circuit part may be configured by a conductor piece that protrudes from a side portion of the conductor plate. The antenna element may configure a monopole antenna, and the antenna element and the short circuit part may configure an inverted F antenna.

As described above, the present invention relates to an antenna device used in various kinds of wireless communication apparatuses, such as mobile telephones provided with a folding structure. The invention can improve the convenience of wireless communication apparatuses—such as preventing the deterioration of antenna characteristics resulting from the antenna coming into close proximity to the grounding conductor within the casings even if the casings are opened and closed, and eliminating protrusions from the casings—and is useful.

The characteristics and advantages of the invention are as listed below.

(1) According to the antenna device of the invention, the antenna device can avoid adverse affects resulting from the antenna coming into close proximity to the grounding conductor within the casings even if the casings are opened and closed, and can improve the convenience of wireless communication apparatuses without causing the antenna characteristics to deteriorate.

(2) According to the antenna device of the invention, the antenna device can ensure antenna characteristics even if the casings are opened and closed by a folding structure, and can be used in, and improve the convenience of, mobile telephones without causing the antenna to protrude from the casings.

(3) According to the wireless communication apparatus of the invention, the wireless communication apparatus can avoid adverse affects for antenna characteristics resulting from the antenna coming into close proximity to the grounding conductor within the casings even if the casings are opened and closed, can maintain stable antenna characteristics, and can raise communication functions.

Other objects, features and advantages of the present invention will become more apparent from the following detailed description of the embodiments thereof when taken in conjunction with the accompanying drawings.

BRIEF DESCRIPTION OF THE DRAWINGS

FIG. 14 is a diagram showing actual measurement values of the antenna device according to the invention.

DETAILED DESCRIPTION OF THE PREFERRED EMBODIMENTS

First Embodiment

Figure 1:
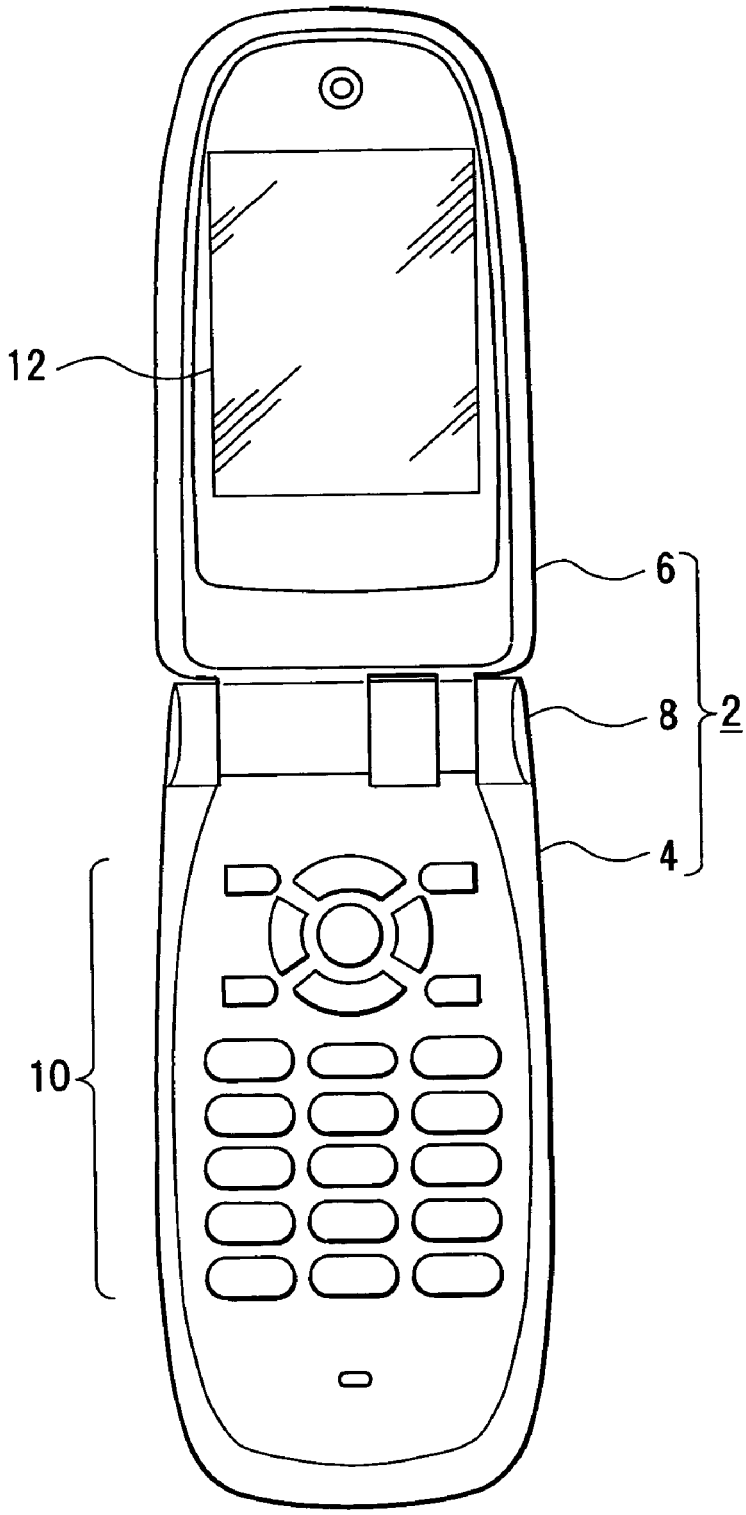
FIG. 1 is a diagram showing a mobile telephone according to a first embodiment of the invention.
Figure 2:
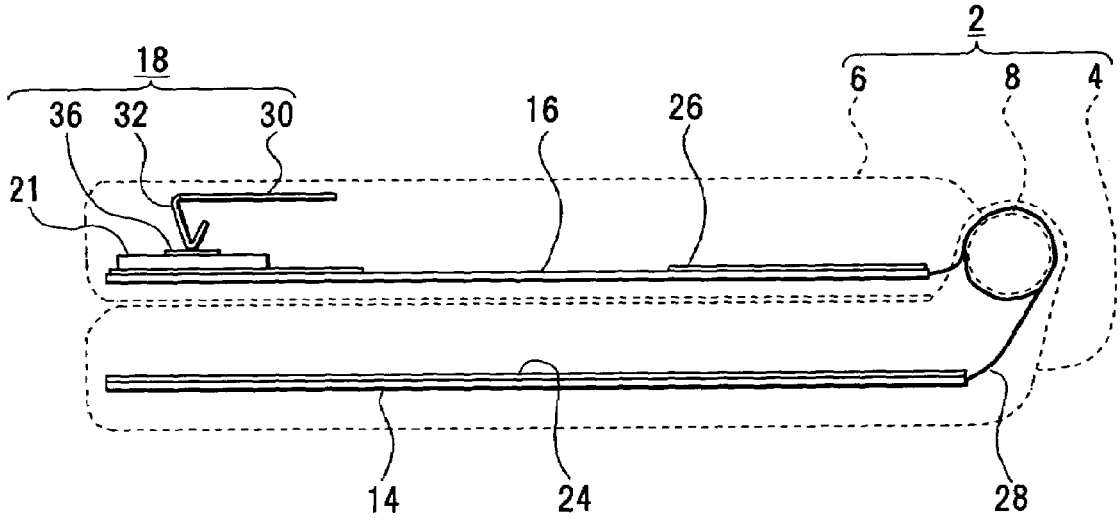
FIG. 2 is a diagram showing an antenna device built into the mobile telephone.
Figure 3:
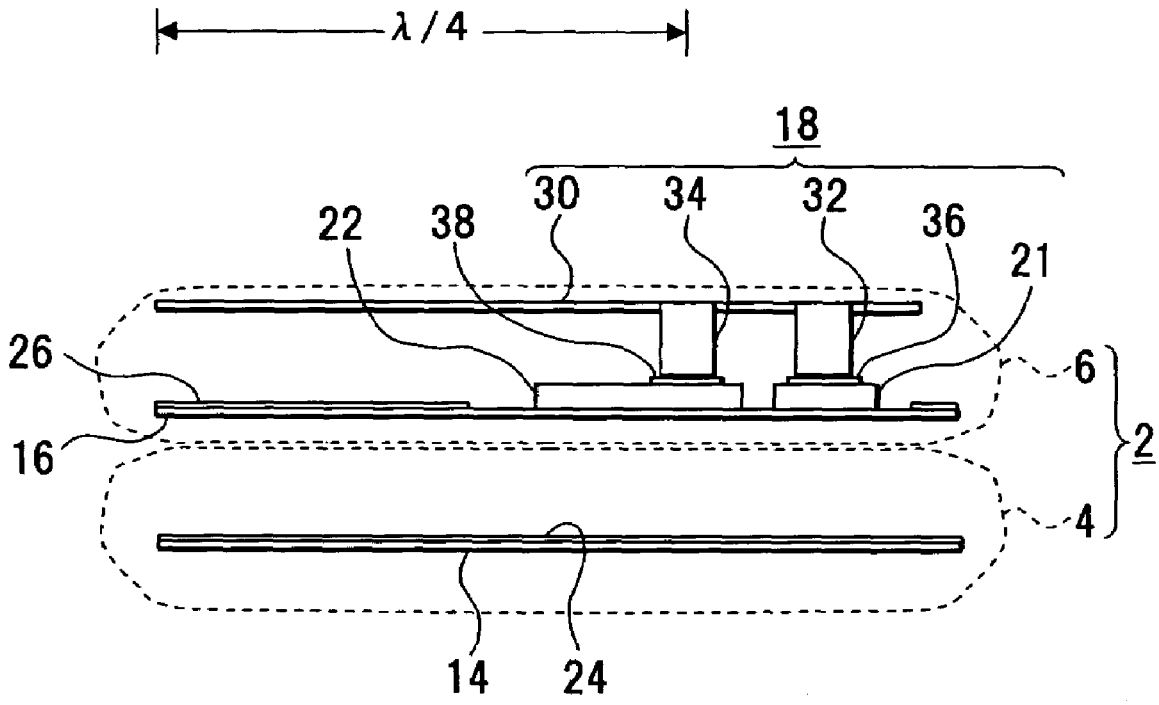
FIG. 3 is a diagram showing the antenna device built into the mobile telephone.

A first embodiment of the invention will be described with reference to FIGS. 1 to 3. FIG. 1 is a diagram showing a mobile telephone 2 according to the first embodiment of the invention, FIG. 2 is a diagram showing an antenna device 18 of the mobile telephone 2, and FIG. 3 is a diagram showing the antenna device 18 of the mobile telephone 2 seen from a direction orthogonal to the direction shown in FIG. 2. In FIG. 1, the mobile telephone 2 is open, and in FIGS. 2 and 3, the mobile telephone 2 is closed.

The mobile telephone 2 is an example of a wireless communication apparatus, and is provided with a first casing 4 and a second casing 6 that are foldable. The two casings 4 and 6 are connected to each other via a hinge 8 serving as an opening/closing mechanism, and are maintained in an open state (FIG. 1) or a closed state (FIGS. 2 and 3). The casing 4 is used as a fixed part and the casing 6 is used as a movable part, for example. A key input part 10 comprising plural keys is disposed in the casing 4, and a liquid crystal display (LCD) 12 is disposed in the casing 6.

A printed wiring board 14 is disposed in the casing 4, and a printed wiring board 16 and the antenna device 18 are disposed in the casing 6. A switch 21 of an operation switch unit 20 (FIG. 6) that switches the operation of the antenna device 18 and a radio part 22 that conducts transmission, reception, or transmission and reception, through the antenna device 18 are mounted on the printed wiring board 16. The operation switch unit 20 (FIG. 6) is configured to include the aforementioned switch 21 and configures a switch circuit that switches the organizational mode and operational mode of the antenna device 18 to a monopole antenna or an inverted F antenna. The radio part 22 is used to transmit and receive radio waves through the antenna device 18, but it may also be configured by one of a wireless transmitter used only for transmitting and a wireless receiver used only for receiving. Also, a grounding conductor (GND) 24 formed on the printed wiring board 14 and a grounding conductor (GND) 26 formed on the printed wiring board 16 are connected via a flexible conductor 28 such as a flexible substrate spanning the hinge 8, and configure same electrical potential points.

The antenna device 18 is provided with an antenna element 30 serving as a first antenna element and a short circuit part 32 and a feeder 34 serving as second antenna elements. The antenna element 30 is set to be longer than ¼

(λ/4) a wavelength λ of a desired frequency f used in transmission and reception, and is disposed along the short direction of the casing 6, e.g., along the inner peripheral wall. The short circuit part 32 is formed at a position in the vicinity of a feeding point (e.g., λ/4) of the antenna element 30—i.e., in the present embodiment, the short circuit part 32 is formed at a position of a distance m (>λ/4) longer than the distance from one end of the antenna element 30 to the feeding point—and is connected to a pad 36 of the switch 21. The feeder 34 is formed at a feeding point of the antenna element 30 and connected to a pad 38 of the radio part 22.

Figure 4:
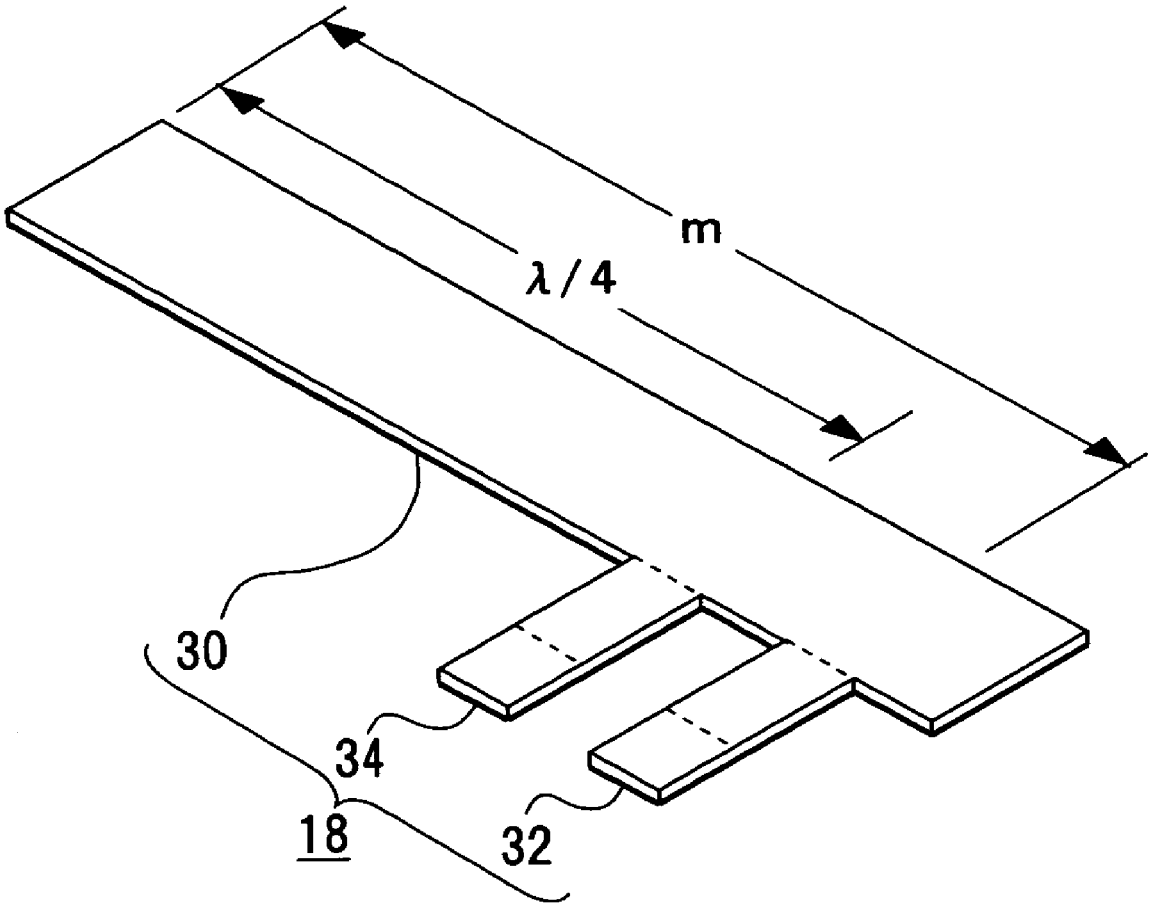
FIG. 4 is a perspective view showing the shape of a conductor plate configuring the antenna device.
Figure 5:
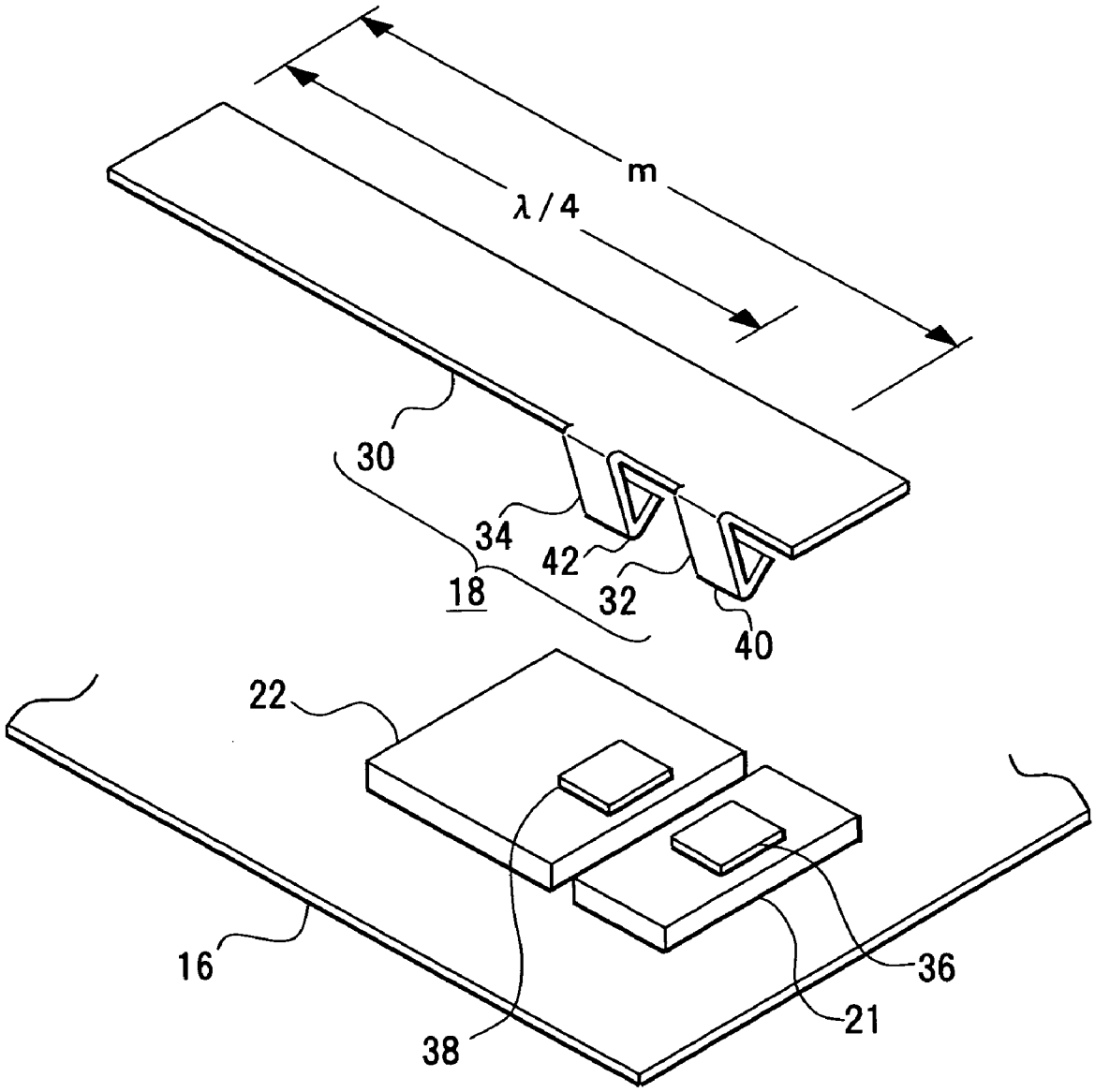
FIG. 5 is a perspective view showing an example of the antenna device, a switch and a radio part.

Next, an example of the antenna device 18 will be described with reference to FIGS. 4 and 5. FIG. 4 is a perspective diagram showing an example of a conductor plate configuring the antenna device 18, and FIG. 5 is a perspective diagram showing an example of the switch 21 and the radio part 22 added to the antenna device 18.

The antenna element 30, the short circuit part 32 and the feeder 34 are configured by a conductor plate, such as a metal plate with excellent conductivity like a copper plate or copper foil, or a metal deposited on the surface of abase material like synthetic resin or a conductor pattern of a printed wiring board, and the short circuit part 32 and the feeder 34 are formed on a side edge portion of one end portion side thereof. The feeder 34 is formed at a position ¼ the wavelength (λ/4; λ: wavelength) set for the antenna element 30 or at a feeding point set in the vicinity thereof. In the present embodiment, the short circuit part 32 and the feeder 34 are protruding pieces of the same shape, bent to slant further toward the surface portion side of the antenna element 30 than the direction orthogonal to the antenna element 30 (FIG. 5), end portion sides are bent in substantial "V" shapes, and the bent portions are formed as connectors 40 and 42. Then, the switch 21 and the radio part 22 are disposed on the surface of the printed wiring board 16, the connector 40 of the short circuit part 32 is connected to the pad 36 formed on the upper surface of the switch 21, and the connector 42 of the feeder 34 is connected to the pad 38 formed on the upper surface of the radio part 22. For the electrical connections between the pad 36 and the connector 40, and between the pad 38 and the connector 42, mechanical contact using the elasticity that the materials configuring the antenna element 30, the short circuit part 32 and the feeder 34 have resulting from the action of stress from the casing 6, or a connecting material such as solder may be used.

Figure 6:
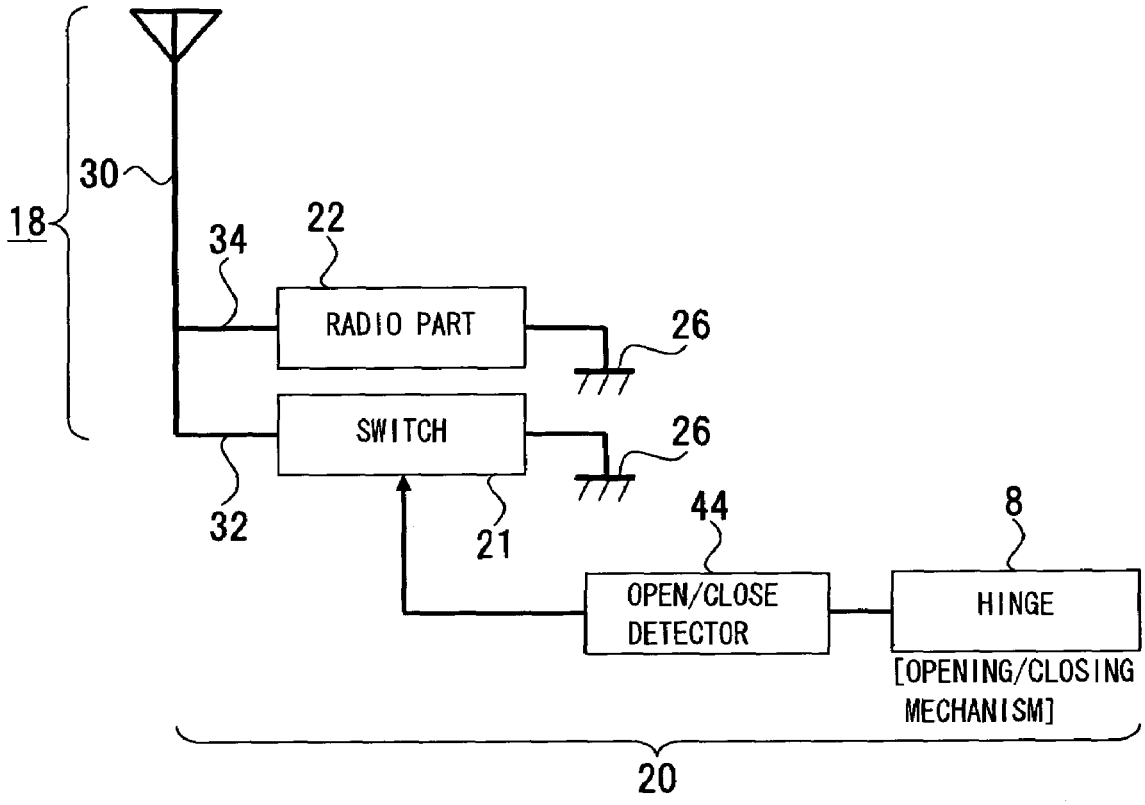
FIG. 6 is a block diagram showing an operation switch unit of the antenna device.

Next, the operation switch unit 20 will be described with reference to FIG. 6. FIG. 6 shows an example of the operation switch unit 20 of the antenna device 18.

The operation switch unit 20 is provided with an open/close detector 44 that detects the opening and closing of the casings 4 and 6 by the hinge 8. The switch 21 connected between the antenna element 30 of the antenna device 18 and the GND 26 is switched by an open/close detection signal outputted from the open/close detector 44. The switch 21 is configured by a PIN diode or single-pole/double-throw switch (SPDT; also single-pole/dual-throw switch), and switches the short circuit part 32 to be connected to or disconnected from the GND 26. The hinge 8 configures the opening/closing mechanism of the casings 4 and 6. When the casings 4 and 6 are open (FIG. 1), the open/close detector 44 generates L output as an open/close detection signal representing that, and when the casings 4 and 6 are closed (FIG. 2), the open/close detector 44 generates H output as an open/close detection signal representing that. Receiving the L output or the H output, the switch 21 is switched OFF when the casings 4 and 6 are open (FIG. 1) and is switched ON when the casings 4 and 6 are closed (FIG. 2). Due to this switching of the switch 21, the short circuit part 32 is cut off from the GND 26 when the casings 4 and 6 are open (FIG. 1), and the short circuit part 32 is connected to the GND 26 and causes a short when the casings 4 and 6 are closed (FIG. 2).

Figure 7:
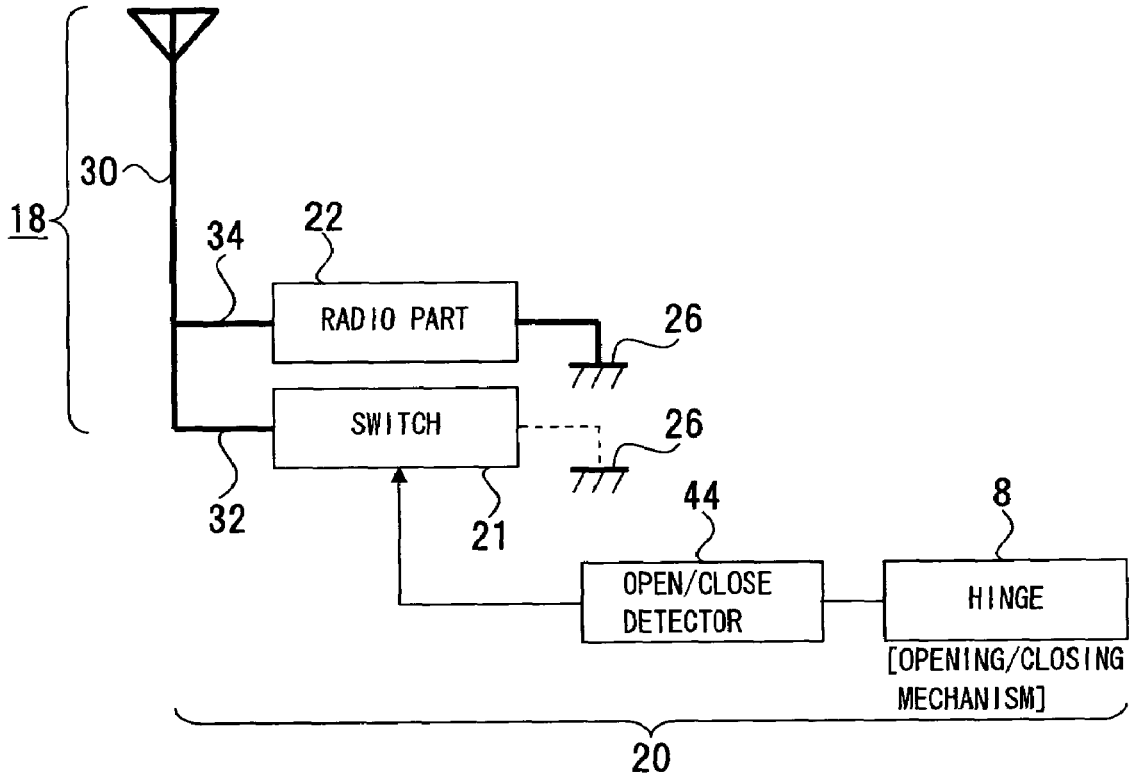
FIG. 7 is a block diagram showing the organization of the antenna device when casings are open.
Figure 8A:
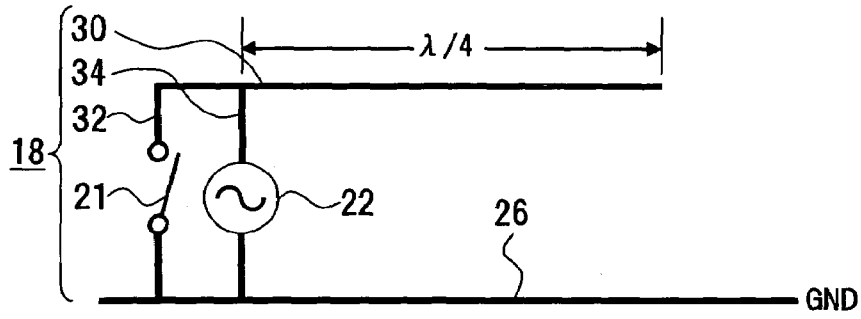
FIGS. 8A to 8C are diagrams showing the organization of the antenna device when the casings are open.
Figure 8B:
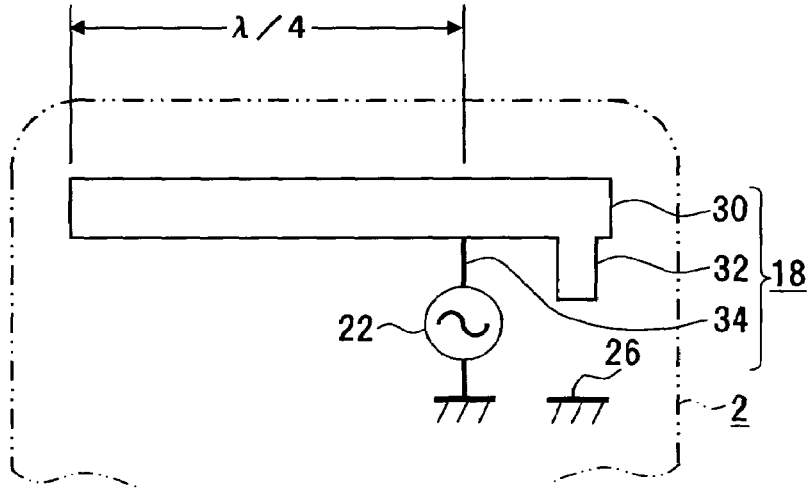
Figure 8C:
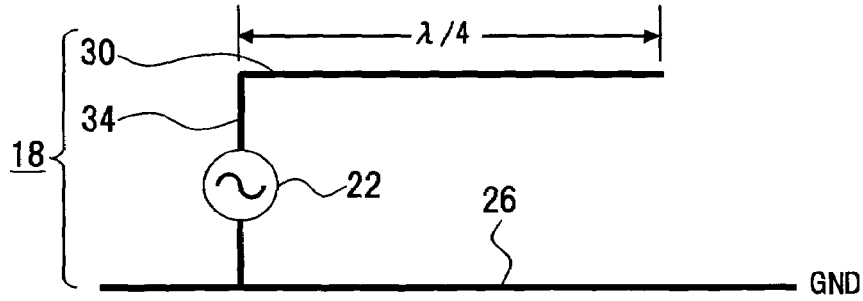
Figure 9:
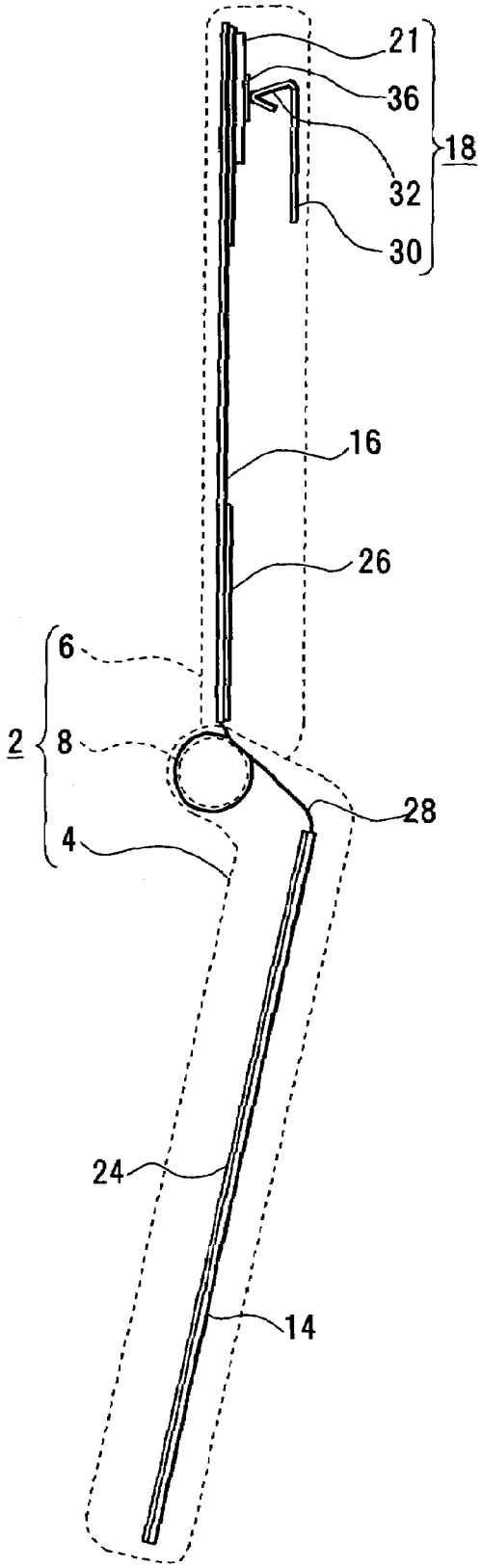
FIG. 9 is a diagram showing the organization of the antenna device when the casings are open.
Figure 10:
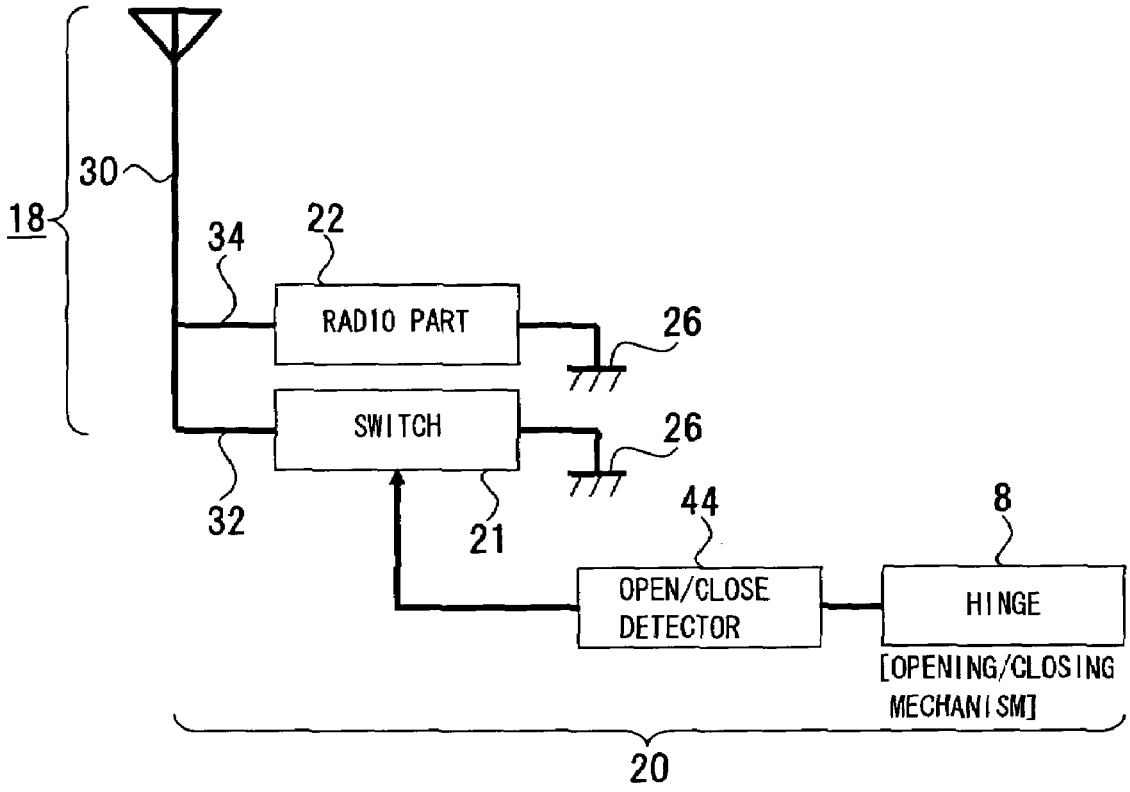
FIG. 10 is a block diagram showing the organization of the antenna device when the casings are closed.

The operation switching of the antenna device 18 of this configuration will be described with reference to FIGS. 7 to 11C. FIG. 7 is a block diagram showing the configuration of the operation switch unit 20 of the antenna device 18 when the switch 21 is OFF, FIGS. 8A to 8C are diagrams showing the organization of the antenna device 18 in this case, and FIG. 9 is a diagram showing the antenna device 18 organized in a state where the casings 4 and 6 are open. FIG. 10 is a block diagram showing the configuration of the operation switch unit 20 of the antenna device 18 when the switch 21 is ON, and FIGS. 11A to 11C are diagrams showing the organization of the antenna device 18 in this case.

When the casings 4 and 6 are open (FIGS. 1 and 9), the switch 21 is OFF (FIG. 7), the short circuit part 32 is cut off from the GND 26 as shown in FIGS. 8A and 8B, and the radio part 22 is connected to the antenna element 30 through the feeder 34. As a result, as shown in FIG. 8C, the antenna device 18 connected to the radio part 22 operates as a monopole antenna, and the antenna element 30 and the GND 24 of the casing 4 are separate from each other in a linear state as shown in FIG. 9, so that affects of the GND 24 with respect to the antenna device 18 can be avoided.

Figure 11A:
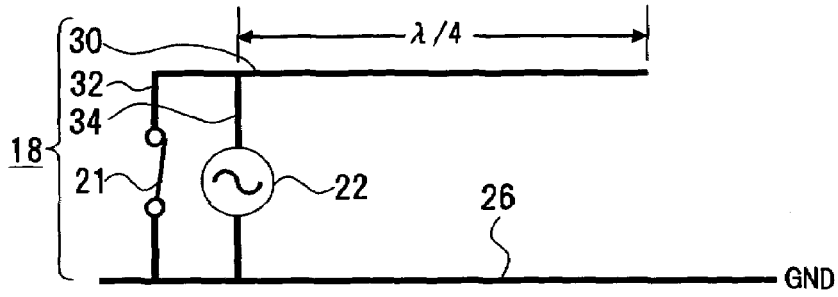
FIGS. 11A to 11C are diagrams showing the organization of the antenna device when the casings are closed.
Figure 11B:
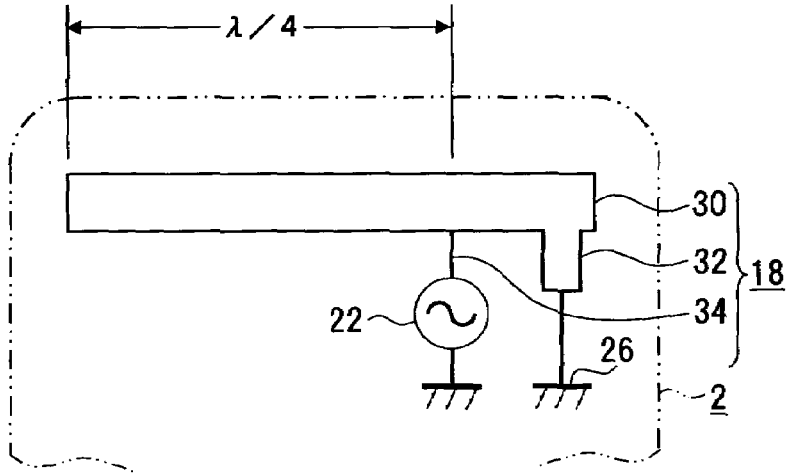
Figure 11C:
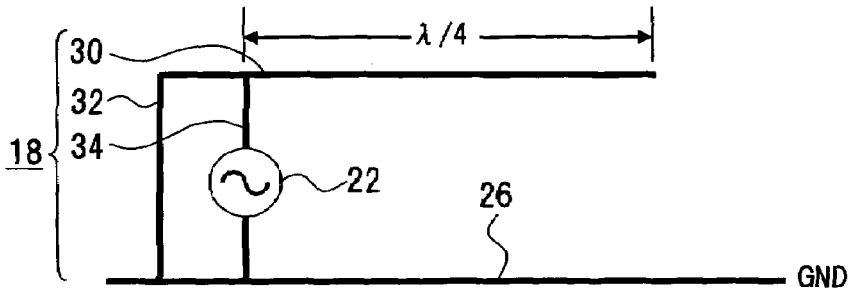

When the casings 4 and 6 are closed (FIGS. 2 and 3), the switch 21 is ON (FIG. 10), the short circuit part 32 is connected to the GND 26 as shown in FIGS. 11A and 11B, and the radio part 22 is connected between the antenna element 30 and the GND 26 together with the short circuit part 32. As a result, as shown in FIG. 11C, the antenna device 18 connected to the radio part 22 operates as an inverted F antenna as a result of the short circuit part 32 functioning. In this instance, the antenna element 30 and the GND 24 of the casing 4 come into proximity in a parallel state as shown in FIG. 3, and due to this proximity, the antenna device 18 effectively functions as an inverted F antenna. Whereas the presence of the GND 24 becomes an obstacle with a monopole antenna, the presence of the GND 24 can be effectively utilized when the antenna device 18 functions as an inverted F antenna.

Second Embodiment

Figure 12:
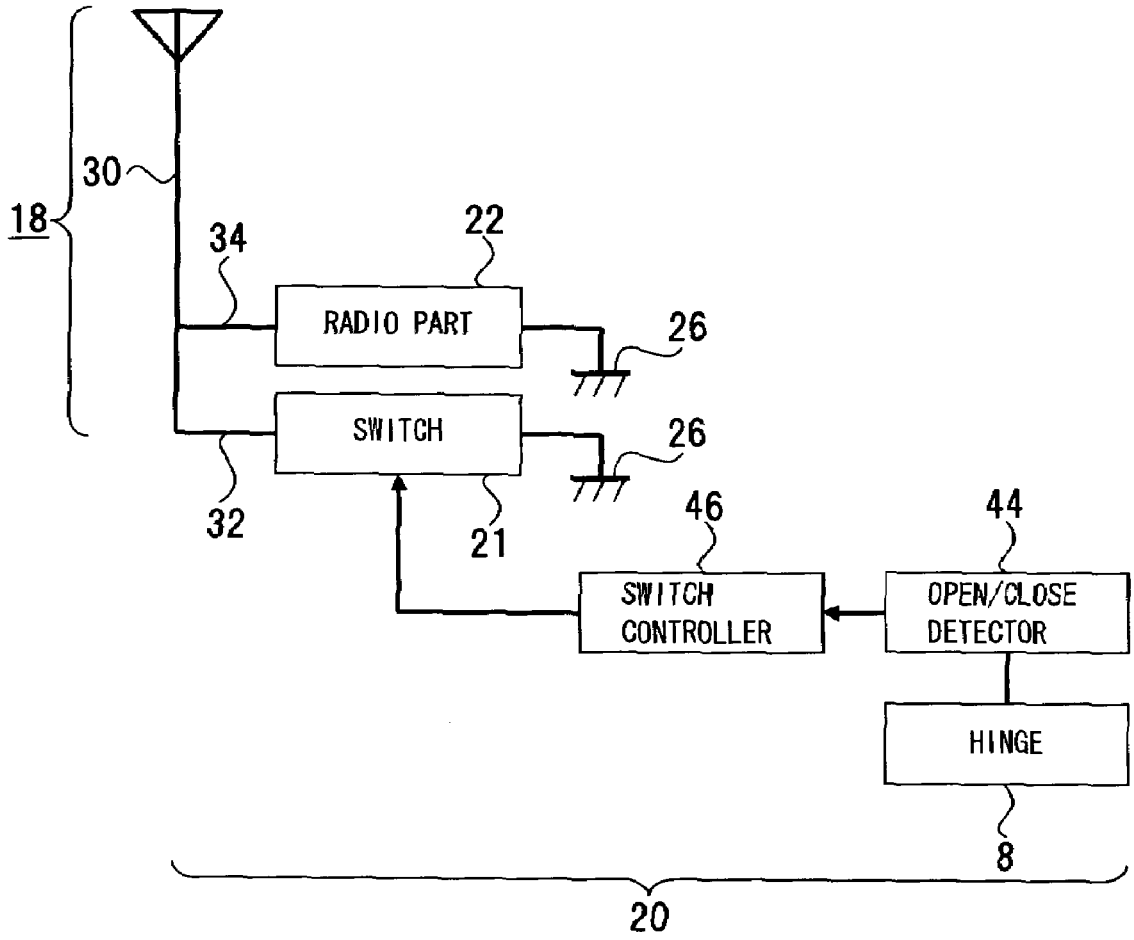
FIG. 12 is a block diagram showing an operation switch unit of an antenna device according to a second embodiment of the invention.

A second embodiment of the invention will be described with reference to FIG. 12. FIG. 12 is a block diagram showing an operation switch unit of an antenna device according to the second embodiment of the invention.

The first embodiment had a configuration where, in relation to the operation switch unit 20, the switch 21 was switched by the open/close detection signal of the open/close detector 44 so that the organization of the antenna device 18 was switched from a monopole antenna to an inverted F antenna, or from an inverted F antenna to a monopole antenna, by the opening and closing of the casings 4 and 6 resulting from the hinge 8. However, the second embodiment includes a switch controller 46 that is given the open/close detection signal of the open/close detector 44 and switches the switch 21 with a switch control signal. The switch controller 46 can be configured by a microprocessor that controls the radio part 22 disposed in the mobile telephone 2.

Third Embodiment

Figure 13:
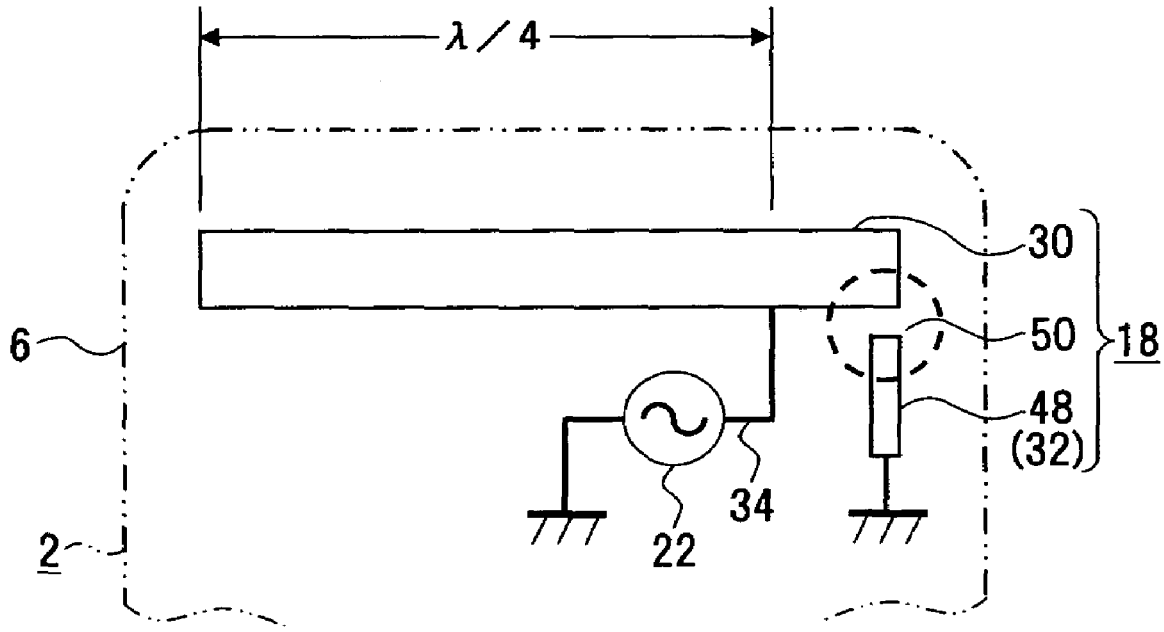
FIG. 13 is a diagram showing an antenna device according to a third embodiment of the invention.

A third embodiment of the invention will be described with reference to FIG. 13. FIG. 13 is a diagram showing an operation switch unit of an antenna device according to the third embodiment of the invention.

In the first and second embodiments, the short circuit part 32 was protruded from the side portion of the antenna element 30, and the switch 21 was intervened in the short circuit part 32. However, here, a short circuit piece 48 may be disposed as a second antenna element independent from the antenna element 30, and an opening/closing part 50 that mechanically opens and closes the space between the short circuit piece 48 and the antenna element 30 may be disposed. By configuring the invention so that the opening/closing part 50 opens and closes in correspondence to the opening and closing of the casings 4 and 6, the antenna device 18 can be made to operate as a monopole antenna when the casings 4 and 6 are open and to operate as an inverted F antenna when the casings 4 and 6 are closed.

Next, actual measurement values of the antenna device 18 of the invention will be described with reference to FIG. 14. FIG. 14 shows gain improvement data of the antenna device 18 accompanying the opening and closing of the casings 4 and 6.

As set forth hereinabove, when the casings 4 and 6 are opened, the antenna device 18 is normalized as a monopole antenna, and when the casings 4 and 6 are closed, the antenna device 18 is normalized as an inverted F antenna. As a result, with respect to the gain of the antenna device 18, characteristic improvements of 1 (dB) when the casings 4 and 6 were open (monopole antenna) and 2.4 (dB) when the casings 4 and 6were closed (inverted F antenna) were confirmed by implementing the invention.

Examples of characteristics and modifications of the above-described embodiments are listed below.

(1) In the preceding embodiments, the antenna device 18 was disposed in the casing 6, but the antenna device 18 may also be disposed in the casing 4.

(2) In the preceding embodiments, the organizational switching of the antenna device 18 was associated with the opening and closing of the casings 4 and 6 in order to switch the antenna device 18 between a monopole antenna and an inverted F antenna, but it is not necessary for the opening/closing mechanism to be configured by the hinge 8. The antenna organization may also be switched by the opening and closing of another open/close portion or by a switch.

(3) In the preceding embodiments, the antenna device 18 was configured by a monopole antenna and an inverted F antenna. This configuration is effective in that the antenna organization can be switched by adding or not adding the short circuit part 32 to the single antenna element 30.

(4) In the preceding embodiments, the mobile telephone 2 was given as an example of a device in which the antenna device 18 may be disposed, but the antenna device 18 may also be applied to a wireless communication apparatus other than the mobile telephone 2.

Although the most preferred embodiments of the present invention have been described hereinabove, it is to be appreciated that the present invention is not limited to the above description and that various changes and modifications will naturally occur to those skilled in the art without departing from the spirit and the scope of the invention defined in the appended claims or disclosed herein. Moreover, needless to say, such changes and modifications are encompassed in the scope of the present invention.

The entire disclosure of Japanese Patent Application No. 2004-318408 including specification, claims, drawings and summary are incorporated herein by reference in its entirety.

What is claimed is:

1. An antenna device built into a casing, the antenna device comprising:

a first antenna element disposed in the casing;

a second antenna element disposed in the casing, the second antenna element being formed on the first antenna element;

a grounding conductor disposed in the casing; and a switch unit that is disposed between the second antenna element and the grounding conductor and opens and closes the second antenna element and the grounding conductor, the switch unit switching connection of the second antenna element and the grounding conductor, wherein an antenna comprising the first antenna element or the second antenna element is configured as a result of the switch unit being switched to an open state, and an antenna comprising the first antenna element and the second antenna element is configured as a result of the switch unit being switched to a closed state wherein the switch unit is opened and closed depending on distance between the first antenna element and the grounding conductor, and wherein the switch unit is closed to configure an antenna comprising the first antenna element, the second antenna element and the grounding conductor in case where the first antenna element and the grounding conductor are close, and the switch unit is opened to configure an antenna comprising the first antenna element or the second antenna element in case where the first antenna element and the grounding conductor are not close.

2. The antenna device of claim 1, wherein the casing is provided with an opening/closing mechanism, and the switch unit is switched to the open state or the closed state in response to the opening and closing of the opening/closing mechanism.

3. The antenna device of claim 1, wherein a feeder is disposed in the first antenna element, and a transmitter or receiver is disposed between the feeder and the grounding conductor.

4. The antenna device of claim 1, wherein the first antenna element is configured by a conductor plate.

5. An antenna device built into a casing, the antenna device comprising:

an antenna element disposed in the casing;

a grounding conductor disposed in the casing;

a short circuit part that causes the grounding conductor and the antenna element to short; and a switch unit that is disposed in the short circuit part and is opened and closed to switch connection of the antenna element and the grounding conductor, wherein an antenna comprising the antenna element is configured as a result of the switch unit being switched to an open state, and an antenna comprising the antenna element and the short circuit part is configured as a result of the switch unit being switched to a closed state wherein the switch unit is opened and closed depending on distance between the antenna element and the grounding conductor, and wherein the switch unit is closed to configure an antenna comprising the antenna element, the short circuit part and the grounding conductor in case where the antenna element and the grounding conductor are close, and the switch unit is opened to configure an antenna comprising the antenna element and the short circuit part in case where the antenna element and the grounding conductor are not close.

6. The antenna device of claim 5, wherein an opening/closing mechanism is disposed in the casing, and the switch unit is switched to the open state or the closed state in response to the opening and closing of the opening/closing mechanism.

7. A wireless communication apparatus including an antenna device built into a casing, the wireless communication apparatus comprising:

a first antenna element disposed in the casing;

a second antenna element disposed in the casing, the second antenna element being formed on the first antenna element;

a grounding conductor disposed in the casing; and a switch unit that is disposed between the second antenna element and the grounding conductor and opens and closes the second antenna element and the grounding conductor, the switch unit switching connection of the second antenna element and the grounding conductor, wherein an antenna comprising the first antenna element or the second antenna element is configured as a result of the switch unit being switched to an open state, and an antenna comprising the first antenna element and the second antenna element is configured as a result of the switch unit being switched to a closed state wherein the switch unit is opened and closed depending on distance between the first antenna element and the grounding conductor, and wherein the switch unit is closed to configure an antenna comprising the first antenna element, the second antenna element and the grounding conductor in case where the first antenna element and the grounding conductor are close, and the switch unit is opened to configure an antenna comprising the first antenna element or the second antenna element in case where the first antenna element and the grounding conductor are not close.

8. The wireless communication apparatus of claim 7, wherein the casing is provided with an opening/closing mechanism, and the switch unit is switched to the open state or the closed state in response to the opening and closing of the opening/closing mechanism.

9. The wireless communication apparatus of claim 7, wherein a feeder is disposed in the first antenna element, and a transmitter or receiver is disposed between the feeder and the grounding conductor.

10. The wireless communication apparatus of claim 7, wherein the first antenna element is configured by a conductor plate.

11. A wireless communication apparatus including an antenna device built into a casing that is opened and closed via a hinge, the wireless communication apparatus comprising:

first and second antenna elements disposed in the casing;

a grounding conductor disposed in the casing;

an open/close detector that detects the opening and closing of the casing; and a switch unit that is disposed between the first antenna element and the second antenna element and is opened and closed by the detection of the opening and closing of the open/close detector, wherein an antenna comprising the first antenna element or the second antenna element is configured as a result of the switch unit being switched to an open state, and an antenna comprising the first antenna element and the second antenna element is configured as a result of the switch unit being switched to a closed state wherein the switch unit is opened and closed depending on detection by the open/close detector, and wherein the switch unit is opened to configure an antenna comprising the first antenna element and the second antenna element in case where the casing are opened, and the switch unit is closed to configure an antenna comprising the first antenna element, the second antenna element and the grounding conductor in case where the casing are closed.

12. A wireless communication apparatus including an antenna device built into a casing, the wireless communication apparatus comprising:

an antenna element disposed in the casing;

a grounding conductor disposed in the casing;

a short circuit part that causes the grounding conductor and the antenna element to short; and a switch unit that is disposed in the short circuit part and is opened and closed to switch connection of the antenna element and the grounding conductor, wherein an antenna comprising the antenna element is configured as a result of the switch unit being switched to an open state, and an antenna comprising the antenna element and the short circuit part is configured as a result of the switch unit being switched to a closed state wherein the switch unit is opened and closed depending on distance between the antenna element and the grounding conductor, and wherein the switch unit is closed to configure an antenna comprising the antenna element, the short circuit part and the grounding conductor in case where the antenna element and the grounding conductor are close, and the switch unit is opened to configure an antenna comprising the antenna element and the short circuit part in case where the antenna element and the grounding conductor are not close.

13. The wireless communication apparatus of claim 12, wherein an opening/closing mechanism is disposed in the casing, and the switch unit is switched to the open state or the closed state in response to the opening and closing of the opening/closing mechanism.

* * * * *